US006112957A

United States Patent [19]

Massullo

[11] Patent Number: 6,112,957

[45] Date of Patent: Sep. 5, 2000

[54] TASSEL MAKING APPARATUS

[75] Inventor: Mary-Helene Massullo, Akron, Ohio

[73] Assignee: Geriche, Inc., Akron, Ohio

[21] Appl. No.: 09/370,718

[22] Filed: Aug. 9, 1999

[51] Int. Cl.[7] ..... A41H 43/00

[52] U.S. Cl. ..... 223/46

[58] Field of Search ..... 223/46, 44, 1; 28/147, 148, 149

[56] References Cited

U.S. PATENT DOCUMENTS

| | | | |
|---|---|---|---|
| 975,355 | 11/1910 | Gurtler . | |
| 1,063,288 | 6/1913 | Rosenberg | 28/147 |
| 1,905,978 | 4/1933 | Arnold . | |
| 2,134,066 | 10/1938 | Van Ness | 28/149 |
| 2,245,903 | 6/1941 | Cone | 223/46 |
| 2,691,469 | 10/1954 | Willig et al. | 223/46 |
| 2,778,210 | 1/1957 | Reizman et al. | 28/149 |
| 3,105,243 | 10/1963 | Kampfe et al. | 2/244 |
| 3,377,674 | 4/1968 | Brassaw et al. | 28/147 |
| 3,854,179 | 12/1974 | Montoya | 28/2 |
| 4,032,052 | 6/1977 | Bates, Jr. | 223/46 |
| 5,356,056 | 10/1994 | Teuten | 223/46 |

*Primary Examiner*—Bibhu Mohanty
*Attorney, Agent, or Firm*—Renner, Kenner, Greive, Bobak, Taylor & Weber

[57] ABSTRACT

A tassel making device is provided having a grip portion on a wand having a plurality of slots along its length. Two rods are inserted into two of these slots at variable selected distances from each other, depending upon the desired size of the tassel to be created. The cylindrical shape of the rods ensures that tassel yarn is not damaged as it is wound about the rods and facilitates its removal from the rods. Longitudinal grooves are provided in the rods so that tassel yarn wrapped about the rods may be easily severed therefrom and tied thereat when forming the tassel. The tassel making device disclosed may also be combined with yarn feeding apparatus that holds a spool containing tassel yarn so that the yarn for creating the tassel is conveniently and easily accessible for controlled payout.

15 Claims, 3 Drawing Sheets

TASSEL MAKING APPARATUS

TECHNICAL FIELD

The present invention relates to a device for making tassels, fringe, and similar decorative elements. More particularly, the present invention relates to a simple, hand-held device for quickly and easily creating tassels of varying dimensions. The device also may be coupled with apparatus for mounting a spool for holding and dispensing thread, yarn, or the like employed to create tassels.

BACKGROUND ART

In making curtains, drapes, shawls, table cloths, bellpulls, pillows, and the like, tassels are often utilized to provide a desired aesthetic appearance. Tassels are also widely used in academic and religious ceremonies, wherein a tassel is attached to a cap. The present invention relates to an improved device for fabricating tassels for any of the above-mentioned purposes.

Prior-art devices for creating tassels provide a base member having grooved rectangular members extending therefrom. Yarn or other tassel material to be employed is wound about these members, tied, and cut to create a tassel. Some prior-art devices also provide a means for adjusting the distance between the grooved members to create tassels of various sizes. When a sufficient number of wrappings have been made about the rectangular members, a short piece of yarn is inserted through the groove underneath the windings around the top grooved element. The short piece of yarn is then knotted around the windings so that the top windings of the tassel are securely fastened together. Another short length of yarn is tied around the windings at a location between the two grooved elements to form the head of the tassel. Finally, the windings are cut along the groove provided in the lower grooved element to release the yarn windings from around that element. The completed tassel is then removed from the top grooved element, thereby completing the creation of a tassel.

In the prior art, the grooved members consist of two flat side walls connected by a bottom wall recessed therebetween to provide a groove. Therefore, tassel yarn is wound around members having a basic rectangular shape with right-angle corners. These corners tend to damage the tassel yarn being wound thereabout. Prior-art tassel making devices also either omit the provision of a handle for making the device easy to use or merely provide a flat hand grip portion along an edge of the base member, which can be awkward and, therefore, tiresome to hold and manipulate for any length of time. Prior-art devices also do not provide a means for supplying tassel yarn to the device. In the prior art, the supply source for the tassel yarn is not incorporated into the device, which has been found in the present invention to markedly increase the ease with which tassels can be made by one person.

Thus, there exists a need in the art for a tassel making device that provides a handgrip portion for manipulating the device for an extended period of time without causing discomfort to the hand. A need also exists for a tassel making device that does not have corners on its grooved members, which may tend to damage the tassel yarn. The need also exists for tassel making apparatus that incorporates a supply source of the tassel yarn into its construction.

DISCLOSURE OF THE INVENTION

In light of the foregoing, it is an object of the present invention to provide a tassel making device having a handle to facilitate the gripping and use of the device over extended time periods.

It is another object of the present invention to provide a tassel making device having easily adjustable and/or replaceable grooved yarn support rods for creating tassels of various sizes.

It is still another object of the present invention to provide a tassel making device wherein the elements contacting the tassel yarn have rounded edges to prevent damage to the tassel yarn, with the rounded edges also serving to prevent minor injuries that are sometimes incurred with the use of sharped-edged, hand-held implements.

It is yet another object of the present invention to provide a tassel making apparatus having yarn feeding apparatus incorporated into its construction for retaining a spool of tassel yarn in order to conveniently supply the yarn needed to utilize the tassel making device to create a desired tassel configuration. Still a further object of the invention is to provide tassel making apparatus having in combination a tassel forming and yarn feeding apparatus, thereby permitting one person to configure, cut, and remove tassels unassisted.

These and other objects of the present invention, which will become apparent from the disclosure hereinbelow, are attained by providing a tassel making device having a handle from which extends a wand having a plurality of slots along its length. These slots are configured to receive first and second tassel rods that extend outwardly from the wand. The first and second tassel rods are cylindrical in shape, having rounded edges. The rods also contain a longitudinal groove along their length to facilitate the creation of a tassel. The tassel making device also provides apparatus for retaining a spool of tassel yarn to conveniently supply support to the spool and, on demand, the tassel yarn needed to create a desired tassel design using the tassel making device.

In general, the present invention contemplates apparatus for making yarn tassels spooled from yarn having a base member, a rod retention portion of the base member, first and second rods selectively attached to the rod retention portion of the base member, the first and second rods each having a cylindrical portion for releasably receiving windings of the yarn and having a distal end and a proximal end relative to the base member, a groove in the cylindrical portion to facilitate tying and cutting operations on windings of the yarn on the first and second rods, and yarn feeding apparatus for mounting the spooled yarn in operative relation to the first and second rods for conveniently wrapping yarn thereabout.

BRIEF DESCRIPTION OF THE DRAWINGS

For a complete understanding of the objects, techniques, and structures of the invention, reference should be made to the following drawings with the accompanying description wherein.

PREFERRED EMBODIMENT FOR CARRYING OUT TI-IE INVENTION

Figure 1:
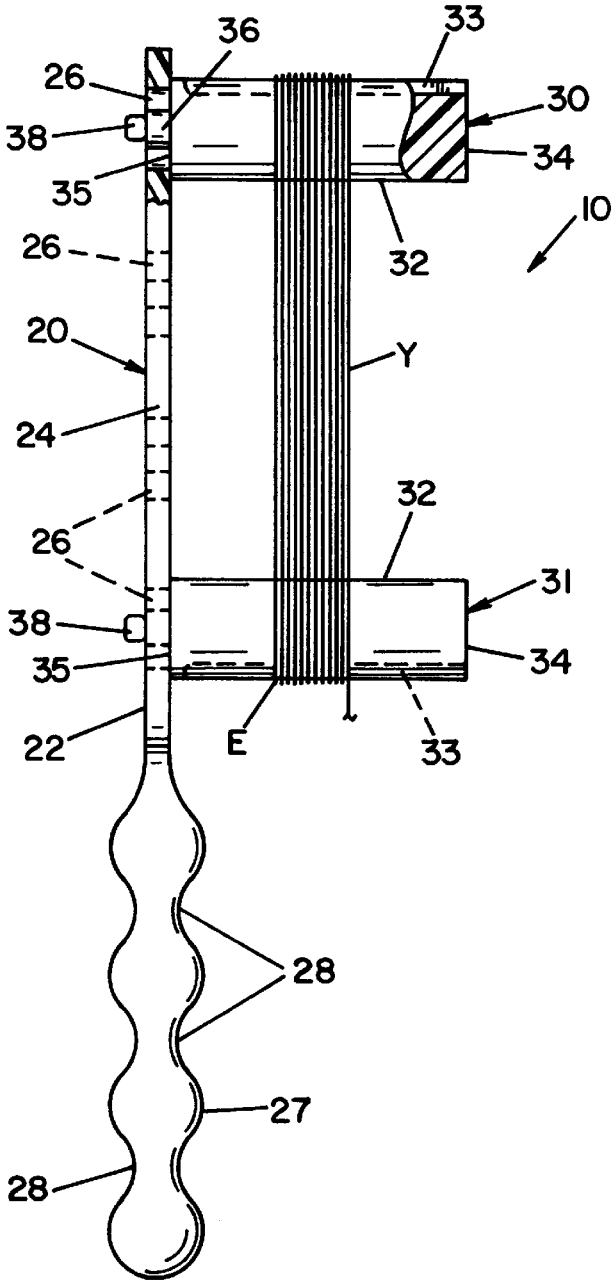
FIG. 1 is a side-elevational view partially in section of a form of tassel making device embodying the concepts of the present invention with a plurality of yarn strands positioned thereon.

Referring now to FIG. 1 of the drawings, a tassel making device according to the concepts of the present invention is designated generally by the numeral 10. The tassel making device 10 has an elongate wand, generally indicated by the numeral 20, from which extends an upper tassel rod, generally indicated by the numeral 30, and a lower tassel rod, generally indicated by the numeral 31. The tassel making device 10 may be combined with yarn feeding apparatus, generally indicated by the numeral 50 (FIG. 7), to facilitate tassel making by one person. It is to be appreciated that in the context of the present application, the word "yarn" shall be deemed to include thread, string, and other woven or non-woven strand-type materials of natural or synthetic components.

Figure 2:
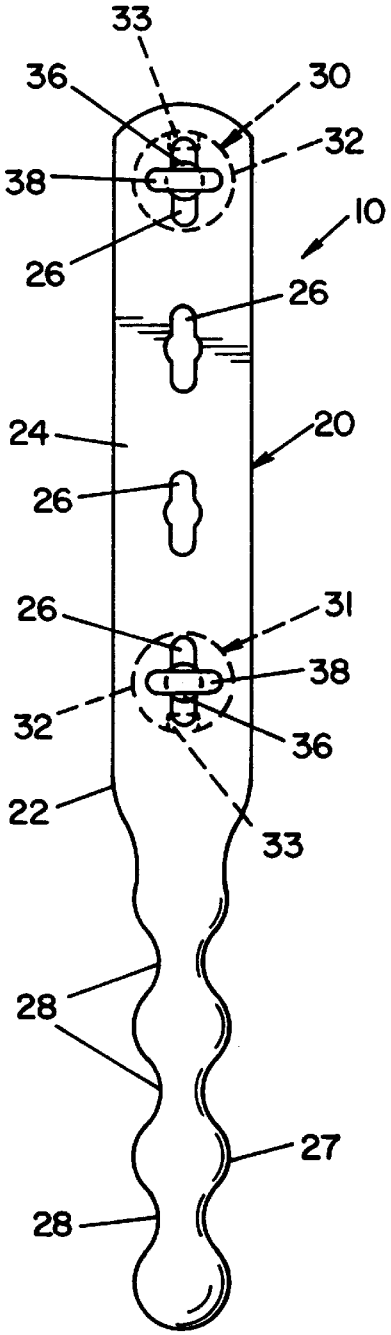
FIG. 2 is a rear-elevational view of the base of the tassel making device of FIG. 1 showing details of the wand and handle portions and attachment of the yarn support rod to the wand.

Referring now to FIGS. 1 and 2, it can be seen that wand 20 has an elongated base portion 22 which includes a rod mounting portion 24. The rod mounting portion 24 contains a plurality of spaced slots 26 provided to receive tassel rods 30 and 31. Base portion 22 has at the end opposite slots 26 a grip portion 27, which preferably has a plurality of peripheral grooves 28 to afford the user a comfortable grasp of the wand 20 for extended manual manipulation. While grip portion 27 is preferably rounded, rod mounting portion 24 is preferably flat, as seen in FIGS. 1 and 2. As will become apparent hereinbelow, the flat shape of rod mounting portion 24 facilitates the positioning and securing of top and bottom tassel rods 30, 31 in substantially parallel relation and substantially perpendicular to the wand 20.

Figure 3:
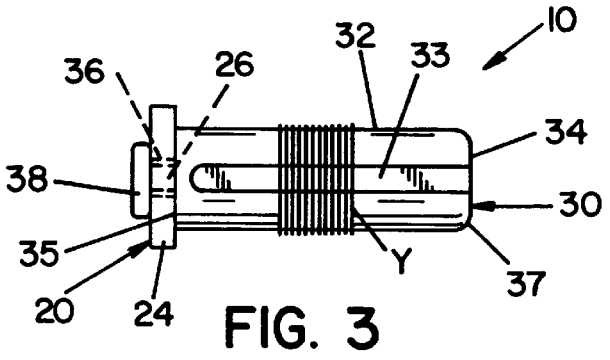
FIG. 3 is a top plan view of one embodiment of support rod mounted on the wand of the tassel making device of the present invention.

One embodiment of the tassel rods 30, 31 is depicted in the side and top views in FIGS. 1 and 3, respectively. It should be understood that while the tassel rod depicted in FIG. 3 is an upper tassel rod 30, lower tassel rod 31 is of an identical structural configuration and differs from upper tassel rod 30 only in its orientation when secured in its operating position on the wand 20. Thus, tassel rods 30, 31 have a cylindrical portion 32 with a longitudinal surface groove 33 extending axially from a distal end 34 of cylindrical portion 32 a substantial distance toward a proximal end 35 and of a width sufficient to receive a needle, strand of yarn, or a cutting implement. From the proximal end 35 of cylindrical portion 32 extends an insertion stem 36, which, as will become apparent from the description hereinbelow, has an axial length substantially equal to the thickness of the rod mounting portion 24 of wand 20. A bayonet 38 is provided at the end of insertion stem 36 and, as can be seen in FIGS. 2 and 3, is oriented perpendicular to cylindrical portion 32. This particular configuration of tassel rods 30, 31 allows for quick and easy securing of tassel rods 30, 31 in any one of the plurality of spaced slots 26 provided along the height of rod mounting portion 24 of wand 20. As shown in FIG. 3, the distal end 34 of rods 30, 31 preferably have rounded corners 37.

To secure upper tassel rod 30 to wand 20, bayonet 38 of upper tassel rod 30 is oriented into a position so that it may be inserted through one of the spaced slots 26. Because insertion stem 36 is of a length substantially equal to the thickness of the rod mounting portion 24 of wand 20, the cylindrical portion 32 of upper tassel rod 30 will abut the surface of rod mounting portion 24 when bayonet 38 exits the confines of the spaced slot 26 through which it has been inserted. Upper tassel rod 30 is then rotated 90 degrees so that longitudinal groove 33 faces upwardly, and upper tassel rod 30 is locked into place at that particular slot 26, with the bayonet 38 in frictional engagement with the surface of rod mounting portion 24 opposite the tassel rod 30.

Lower tassel rod 31 is secured to the rod mounting portion 24 of wand 20 in the same manner; however, lower tassel rod 31 is rotated 90 degrees so that the longitudinal groove 33 faces downwardly. The outward orientation of the longitudinal grooves 33, facing upwardly from upper tassel rod 30 and downwardly from lower tassel rod 31, is significant when utilizing the tassel making device 10 of the present invention, as will become apparent from the following description of the use of the tassel making device 10.

Figure 4:
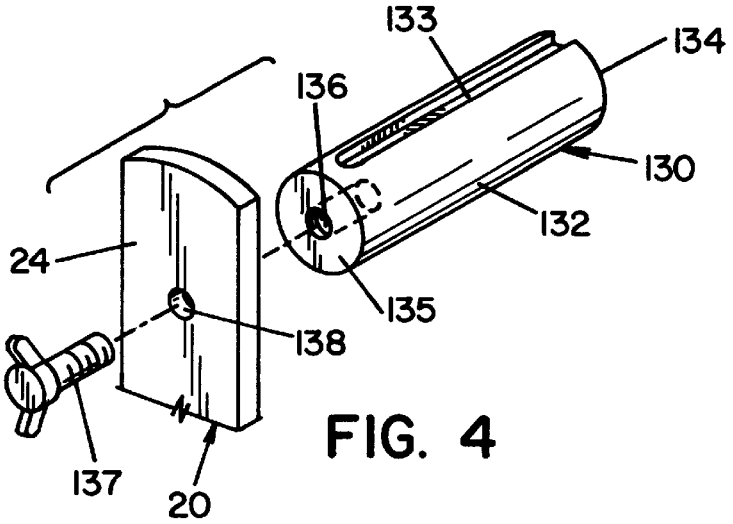
FIG. 4 is an exploded perspective view of an alternative embodiment of support rod according to the present invention.

A second embodiment of the tassel rods 30, 31 is shown generally in FIG. 4 as tassel rod 130. The tassel rod 130 has a cylindrical portion 132 with a longitudinal groove 133 extending from a distal end 134 of rod 130 a substantial distance toward a proximal end 135. In this embodiment, the insertion stem 36 and bayonet 38, described above, are replaced with a threaded bore 136 extending into proximal end 135 of cylindrical portion 132. When this second embodiment of the tassel rods 30, 31 is employed, a series of apertures 138, rather than slots 26, are located longitudinally of the rod mounting portion 24 of wand 20 to receive a winged screw or fastener 137, which engages the threaded bore 136 in rod 130. It should be apparent that this embodiment of tassel rods 30, 31 also allows for quick and easy securing of the rods at selected locations along the rod mounting portion 24 of wand 20. It should be noted that the attachment of tassel rod 130 to rod mounting portion 24 of wand 20 could be modified, such as by fixedly securing a screw into proximate end 135, inserting this screw through selected aperture 138, and subsequently securing such modified tassel rod 130 in place by means of a wing nut threaded onto the protruding screw.

When considering the description, disclosed hereinabove, of the use of the tassel making device 10, it should be understood that whenever reference is made to tassel rods 30, 31, tassel rod 130 may be substituted therefor, provided that when such a substitution is made, references to spaced slot 26 would preferably be replaced by reference to aperture 138.

In utilizing the tassel making device 10 to create a tassel, tassel rods 30, 31 are each secured through a spaced slot 26 in the manner described above so that the longitudinal groove 33 of upper tassel rod 30 faces upwardly, while the longitudinal groove 33 of lower tassel rod 31 faces downwardly. While only two spaced slots 26 are utilized to secure the tassel rods 30, 31, a multitude of spaced slots 26 are provided so that tassel rods 30, 31 may be secured at varying distances from each other to allow for the creation of tassels of varying lengths. After securing the tassel rods 30, 31, tassel yarn Y is wrapped around the tassel rods 30, 31, as indicated in FIG. 1, preferably starting with an end E proximate the bottom tassel rod 31. When the desired fullness is attained, a piece of yarn P under the strands of yarn Y in the longitudinal groove 33 is passed under the strands of yarn Y bridging the longitudinal groove 33 of upper tassel rod 30, and the yarn Y is tied off in a knot K to secure the tassel yarn Y at this top point, as seen in FIG. 5.

A loop L may be provided at the top point to facilitate attaching a completed tassel T for its ultimate use. A second piece of yarn P' is looped around the tassel yarn Y and tied at a position between the tassel rods 30, 31, so as to form the head of the tassel, as seen in FIG. 5. A knife, scissors, or other cutting implement is then used to sever the tassel yarn windings Y at the longitudinal groove 33 of lower tassel rod 31, and the head portion of the tassel is slid off of upper rod 30 to complete the fabrication of a tassel T.

Figure 5:
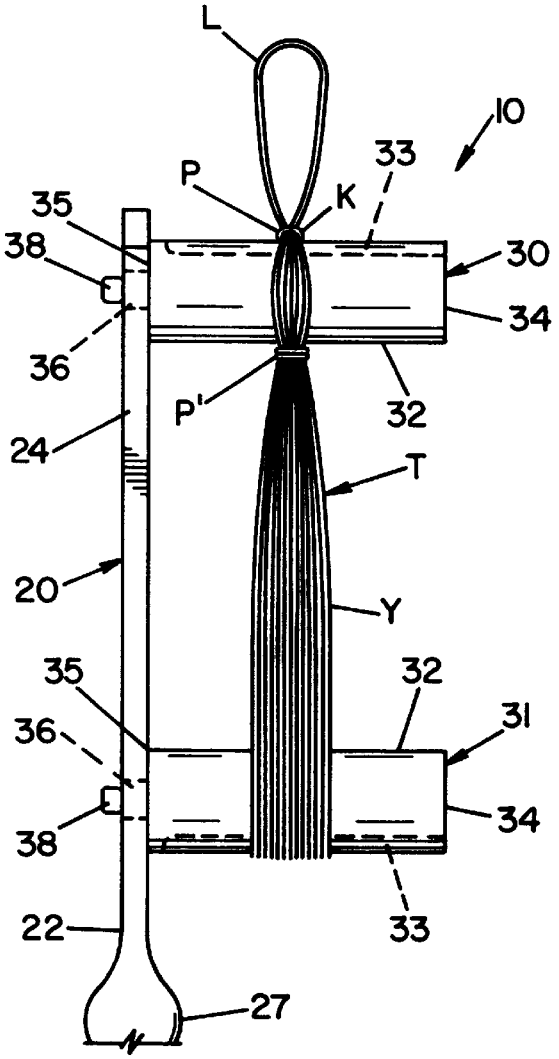
FIG. 5 is a fragmentary, side-elevational view, similar to FIG. 1, showing a tassel in an intermediate state of construction.
Figure 6:
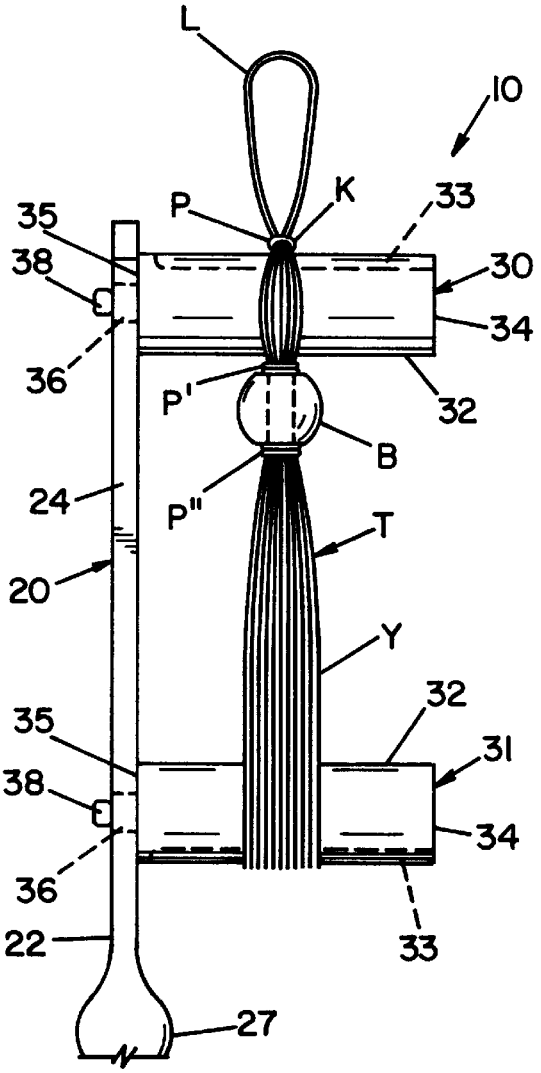
FIG. 6 is a fragmentary, side-elevational view, similar to FIG. 5, showing a tassel incorporating a decorative bead in an intermediate state of construction.

FIG. 6 is a depiction similar to FIG. 5 showing the addition of a bead B or other decorative member on a tassel T according to the present invention. As shown, the bead B is positioned on the wraps of yarn Y, removing the wraps from the lower tassel rod 31, threading the bead B thereover, and replacing the wraps of yarn Y on the lower tassel rod 31. A third piece of yarn P" is positioned and tied below bead B, which is normally seated against the second piece of yarn P'. The yarn windings Y may then be severed, and the completed tassel T is removed from the device 10 in the manner described in connection with FIG. 5, above.

The cylindrical portions 32 of tassel rods 30, 31 prevent the tassel yarn Y from fraying as it is wound about these members and can also prevent minor injuries that may occur when sharp edges are present in hand-held and hand-manipulated devices. The cylindrical portions 32 also greatly facilitate sliding the yarn wraps Y on and off of the tassel rods 30, 31 in performing the various operations in fabricating tassels described above.

Figure 7:
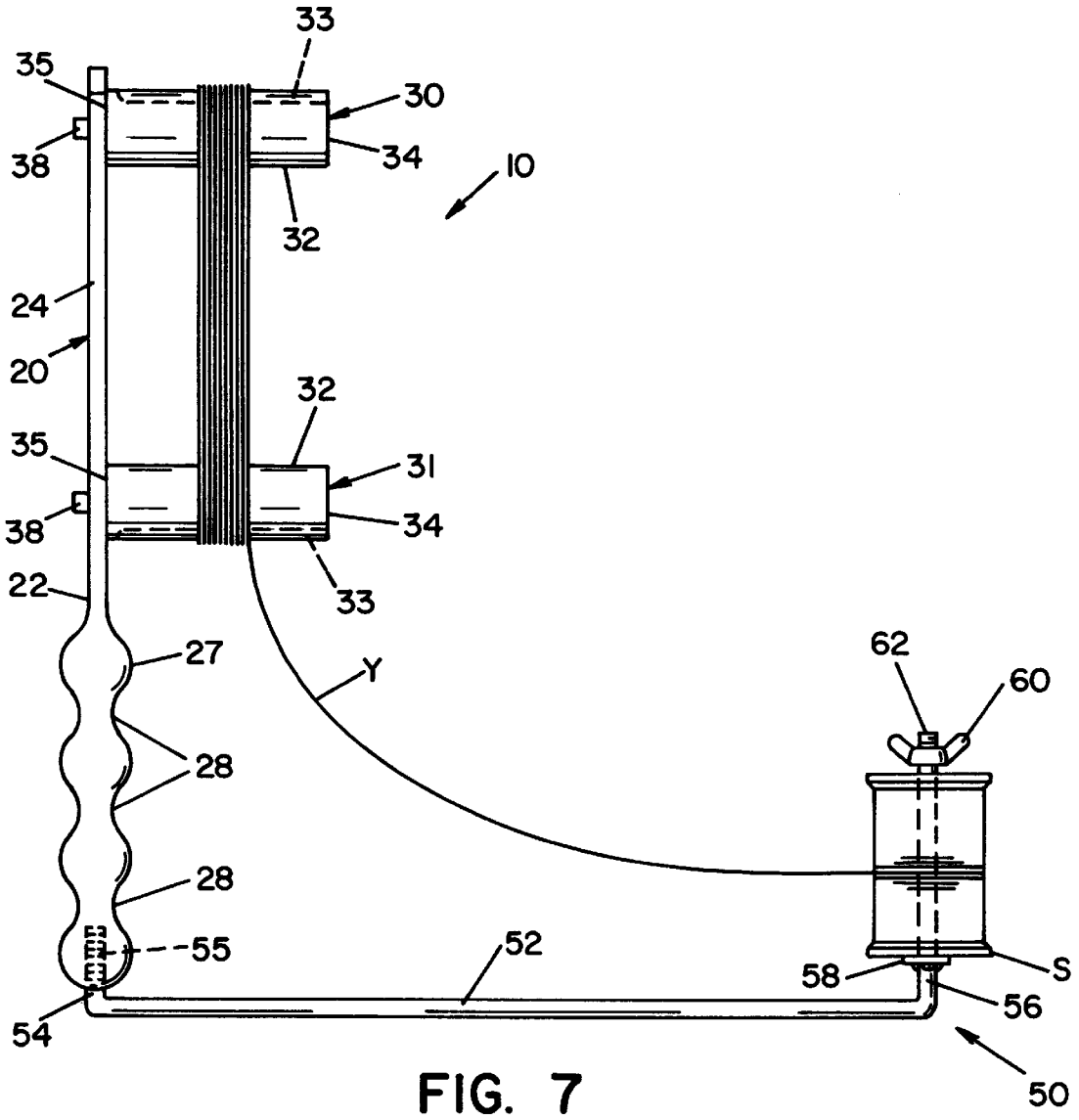
FIG. 7 is a side-elevational view of the tassel making device of FIG. 1 shown in combination with an integrated yarn feeding apparatus according to the concepts of the present invention.

Referring to FIG. 7, it can be seen that the tassel making device 10 may be combined with an integrated yarn feeding apparatus, generally indicated by the numeral 50, which serves as a means for supplying a source of tassel yarn Y to be used for creating tassels T. The feeding apparatus 50 has an elongate spacer 52 extending a distance away from the wand 20. Extending upwardly from one end of the spacer 52 and preferably formed integrally therewith is a vertical stem 54 that extends into the grip portion 27 of wand 20 and secured by means of mating threads 55. The other end of spacer 52 includes a vertically-oriented spool shaft 56 on which a spool S of thread or ball of yarn may be freely rotatably mounted. The spool shaft 56 may be provided with a stop 58 that supports the lower end of spool S and a wing nut 60, or other suitable fastener, which threads on a threaded end 62 of spool shaft 56 to restrain spool S on the shaft 56. As seen in FIG. 7, the spool S rotates about the spool shaft 56 as yarn Y is manually drawn or payed out from the spool S and wound around upper and lower tassel rods 30, 31. This obviates the necessity for a person operating tassel making device 10 from trying to hold and control the spool S, as well as device 10 with one hand while wrapping yarn Y with the other hand. Providing the tassel making device 10 with yarn feeding apparatus 50 provides the person using the device 10 with a convenient, automated supply source of tassel yarn Y. If desired, the spacer 52 may be made for retention on a tabletop or fixture to further simplify its positioning during operation.

Thus, it should be evident that the tassel making apparatus disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A device for making tassels from yarn comprising, a base member, a grip portion of said base member for grasping and manually manipulating the device, a rod mounting portion of said base member, an aperature in said rod mounting portion first and second rods each having a threaded bore and each being selectively attached to said rod mounting portion of said base member by a threaded fastener extending through said aperature and engaging said threaded bore to selectively temporarily affix said rods to said base member, said first and second rods each having a cylindrical portion for releasably receiving windings of the yarn and having a distal end and a proximal end relative to said base member, and a groove in said cylindrical portion to facilitate tying and cutting operations on windings of the yarn positioned on said first and second rods.

2. A device according to claim 1, wherein said groove in said cylindrical portion of said first and second rods is oriented axially thereof.

3. A device according to claim 1, wherein said groove in said cylindrical portion of said first and second rods extends from said distal end a substantial distance toward said proximal end.

4. A device according to claim 1, wherein said groove in said cylindrical portion of said first and second rods extends longitudinally thereof from said distal end to a position proximate to said proximal end.

5. A device according to claim 1, wherein said first rod is a top rod and said second rod is a bottom rod, said groove in said top rod being at the top thereof and said groove in said bottom rod being at the bottom thereof.

6. A device according to claim 1, wherein said first and second rods are mounted substantially perpendicular to said base member and mutually parallel to each other.

7. A device according to claim 1, wherein said base member has a plurality of apertures positioned along said rod receiving portion of said base member for varying the distance between said rods to produce tassels of differing lengths.

8. A device for making tassels from yarn comprising, a base member, a grip portion of said base member for grasping and manually manipulating the device, a rod mounting portion of said base member, a plurality of elongate slots in said rod mounting portion first and second rods each having an insertion stem and each being selectively attached to said rod mounting portion of said base member by the receipt of said insertion stem within one of said plurality of elongate slots, said first and second rods each having a cylindrical portion for releasably receiving windings of the yarn and having a distal end and a proximal end relative to said base member, and a groove in said cylindrical portion to facilitate tying and cutting operations on windings of the yarn positioned on said first and second rods.

9. A device according to claim 8, wherein said insertion stem has a bayonet that may be inserted through one of said elongate slots, whereby rotation of said rods temporarily locks them in place on said base member.

10. A device according to claim 8, wherein said base member has a plurality of slots positioned along said rod receiving portion of said base member for varying the distance between said rods to produce tassels of differing lengths.

11. Apparatus for making yarn tassels from spooled yarn comprising, a base member, a rod mounting portion of said base member, first and second rods selectively attached to said rod mounting portion of said base member, said first and second rods receiving windings of the yarn and having a distal end and a proximal end relative to said base member, a groove in said first and second rods to facilitate tying and cutting operations on windings of the yarn on said first and second rods, and yarn feeding apparatus for mounting the spooled yarn in operative relation to said first and second rods for conveniently wrapping yarn thereabout.

12. Apparatus according to claim 11, wherein said yarn feeding apparatus includes a spool shaft for freely rotatably mounting the spooled yarn.

13. Apparatus according to claim 12, wherein said spool shaft has a stop for supporting the spooled yarn and a fastener to retain the spooled yarn on said spool shaft.

14. Apparatus according to claim 12, wherein said yarn feeding apparatus includes a stem affixed to said base member and a spacer interposed between said stem and said spool shaft.

15. Apparatus according to claim 11, wherein said base member has a grip portion for grasping and manually manipulating said base member.

* * * * *

UNITED STATES PATENT AND TRADEMARK OFFICE

CERTIFICATE OF CORRECTION

PATENT NO. : 6,112,957
DATED : September 5, 2000
INVENTOR(S) : Mary-Helene Massullo It is certified that error appears in the above-identified patent and that said Letters Patent is hereby corrected as shown below:

Column 8,
Line 8, should read
-- 16. A device according to claim 8, wherein said groove in said cylindrical portion of said top and bottom rods extends from said distal end a substantial distance toward said proximal end. --

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,112,957
DATED : September 5, 2000
INVENTOR(S) : Mary-Helene Massullo It is certified that error appears in the above-identified patent and that said Letters Patent is hereby corrected as shown below:

Column 8,
Line 8, should read
-- 16. A device according to claim 8, wherein said groove in said cylindrical portion of said top and bottom rods extends from said distal end a substantial distance toward said proximal end. --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*